US008806786B2

(12) United States Patent
Jiang et al.

(10) Patent No.: US 8,806,786 B2
(45) Date of Patent: Aug. 19, 2014

(54) STEAMER HEAD FOR A GARMENT STEAMER

(75) Inventors: Yong Jiang, Singapore (SG); Sahil Wadhwa, Singapore (SG); Christianus Martinus Van Heesch, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/883,772

(22) PCT Filed: Nov. 15, 2011

(86) PCT No.: PCT/IB2011/055087

§ 371 (c)(1), (2), (4) Date: May 7, 2013

(87) PCT Pub. No.: WO2012/066473

PCT Pub. Date: May 24, 2012

(65) Prior Publication Data

US 2013/0219758 A1 Aug. 29, 2013

(30) Foreign Application Priority Data

Nov. 18, 2010 (EP) ..... 10191618

(51) Int. Cl.
*D06F 75/38* (2006.01)
*D06C 7/00* (2006.01)

(52) U.S. Cl.
USPC ..... 38/75; 38/93; 38/144; 68/222

(58) Field of Classification Search
CPC ..... D06F 75/10; D06F 75/22; D06F 75/26; D06F 75/38; D06F 75/08; D06F 75/12; D06F 75/14; D06F 75/16; D06F 75/30; A47L 11/30; A47L 11/34
USPC ..... 38/93, 77.1, 77.5, 77.9, 88, 75, 144; 68/222; 15/241, 320, 321, 328, 344, 15/345
See application file for complete search history.

(56) References Cited

U.S. PATENT DOCUMENTS 3,262,146 A * 7/1966 Hays ..... 15/321
3,706,146 A * 12/1972 Anderson ..... 38/75
(Continued)

FOREIGN PATENT DOCUMENTS

DE 10211879 A1 10/2002
EP 0200807 A1 8/1972
(Continued)

*Primary Examiner* — Ismael Izaguirre

(57) ABSTRACT

The present invention relates to a steamer head for a garment steamer comprising a main body (2) with a front end (8), a steam outlet (11) and an air inlet (25) formed in the front end (8). A suction force is applied to draw air through the air inlet (25) so that a fabric of a garment disposed proximate the front end (8) is drawn against the front end (8) by the suction force. Further, steam is applied to the fabric of a garment through the steam outlet (11). The front end (8) of the main body (2) comprises first and second surfaces (10, 2). The steam outlet (11) is formed in the first surface (10) and the air inlet (25) is formed in the second surface (12), so that the fabric is drawn against the second surface (12) and steam is applied to the fabric at the first surface (10). The first and second surfaces (10, 12) together forma convex surface. The present invention also relates to a garment steamer comprising a 10 steamer head and a method of removing creases from a garment using a garment steamer.

19 Claims, 3 Drawing Sheets

(56) References Cited

U.S. PATENT DOCUMENTS

| | | | | |
|---|---|---|---|---|
| 3,721,026 | A * | 3/1973 | McCallum | 38/75 |
| 4,196,340 | A | 4/1980 | Evans, Jr. et al. | |
| 4,583,260 | A * | 4/1986 | Zai | 38/75 |
| 5,341,541 | A * | 8/1994 | Sham | 15/320 |
| 5,502,872 | A * | 4/1996 | Chae et al. | 15/320 |
| 5,613,271 | A * | 3/1997 | Thomas | 15/321 |
| 5,819,364 | A * | 10/1998 | Sham | 15/320 |
| 6,571,421 | B1 * | 6/2003 | Sham et al. | 15/320 |
| 6,934,995 | B2 * | 8/2005 | Wheeler et al. | 15/344 |
| 7,752,705 | B2 * | 7/2010 | McDowell et al. | 15/320 |
| 2004/0084433 | A1 | 5/2004 | Field et al. | |

FOREIGN PATENT DOCUMENTS

| | | | |
|---|---|---|---|
| EP | 0493348 | A1 | 7/1992 |
| GB | 993866 | A | 6/1965 |
| GB | 1287298 | A | 8/1972 |
| GB | 2456764 | A | 7/2009 |
| WO | 02070811 | A2 | 9/2002 |

* cited by examiner

STEAMER HEAD FOR A GARMENT STEAMER

FIELD OF THE INVENTION

The present invention relates to a steamer head for a garment steamer. Furthermore, the present invention also relates to a garment steamer comprising a steamer head and a method of removing creases from a garment using a garment steamer.

BACKGROUND OF THE INVENTION

Apparatus for removing creases from the fabric of a garment are commonly known. Such apparatus generally comprise an ironing board with an upper surface on which a garment is placed, and an iron with a heated sole plate which is pressed against the garment on the upper surface of the ironing board. The use of heat generated by the heated sole plate together with pressure applied by the iron removes creases in the fabric. To further aid the removal of creases, irons are also known to include steam generating means and a plurality of steam holes formed in the heated sole plate through which steam is expelled against the fabric of a garment. Moisture from the steam is used to relax the fabric fibres, while heat from the heated plate raises the fabric material to its glass transition temperature and subsequently dries it to retain its flatness. Therefore, a combined use of heat, moisture and pressure is applied to the fabric to remove the creases formed therein.

However, a disadvantage of the above arrangement is that ironing boards are cumbersome to set-up and store, and take up a large amount of working space during use.

An attempt to deal with the abovementioned problems with conventional irons and ironing boards is known from US 2004/0084433 A1. In this document an iron is known which comprises a heated sole plate with a plurality of steam outlet holes formed in a circular arrangement in the sole plate. A plurality of air vent holes are formed in a circular arrangement around the plurality of steam outlet holes, and a vacuum pump means is formed in the iron to suck air through the air vent holes. When the fabric of a garment is positioned against the heated sole plate, the vacuum pump means is operated so that a low pressure is generated at the sole plate and so the fabric is drawn against the heated sole plate.

However a problem with the iron disclosed in this document, and other known irons, is that the heated sole plate, heating means for heating the heated plate and the steam generating means for producing steam are all enclosed in the main body of the iron. Therefore, the main body of the iron is heavy, difficult to manoeuvre and cannot be held by a user for any considerable length of time without resting the iron on an ironing board or an other surface. Additionally, irons must be of a sufficient size to include a water tank and water delivery system. Therefore, the mobility of a known iron is restricted due to the size and weight of the iron. Another problem with the iron in US 2004/0084433 A1 is that the flow of steam and air through the steam outlet holes urges the fabric of a garment away from the heated sole plate and so reduces the effectiveness of the iron.

Known irons also require a heat control to regulate the temperature of the heated sole plate to account for different types of fabric. Dependent on the type of fabric the iron will either not remove creases if the heat control is set too low, or burn the fabric of the garment if the heat control is set to be too high. In addition, known irons also rely on the pressure applied by the heated sole plate against an ironing board, to remove creases. Furthermore, as irons require a heated sole plate to remove creases from a fabric, the heated sole plate can cause scorching and/or burning of the fabric if the heated sole plate is left in one position on the fabric.

Garment steamers are known for steaming garments to remove creases from a fabric material of a garment through the use of heat and moisture. Such a garment steamer generally comprises a steam generating unit and a steamer head connected to the steam generating unit by a steam hose through which steam is conveyed to the steamer head. The steamer head is provided with a steam outlet to discharge steam onto the fabric being treated. Typically, the garment is hung on a hanger during treatment by the steamer and the user stretches the garment with one hand while the steamer head is manipulated over the garment with the other hand. However, conventional garment steamers have the problem that the flow of steam from the steamer head urges the garment away from the steamer head when the steamer head is positioned against the garment.

In an attempt to solve the above problems with conventional steamers, a user needs to hold the garment against the steamer head. However, this requires a two handed operation and the user's hand is positioned in the way of the steamer head and so may be scolded by the steam exhausted from the steamer head. Protective gloves and pads are known for supporting the garment from behind while the steamer head is pressed and moved across the garment to aid the removal of creases and to help prevent injury to a user. A further disadvantage is that it is difficult to manipulate the garment which is hung on the hanger to avoid unintended folds and creases and to keep the garment steady during the treatment.

SUMMARY OF THE INVENTION

Therefore, it is an object of the invention to provide a steamer head for a garment steamer which substantially alleviates or overcomes the problems mentioned above.

According to the present invention, there is provided a steamer head for a garment steamer comprising a main body with a front end, a steam outlet and an air inlet formed in the front end, wherein a suction force is applied to draw air through the air inlet so that a fabric of a garment disposed proximate the front end is drawn against the front end by the air suction means and steam is applied to the fabric of a garment through the steam outlet.

The front end of the main body comprises first and second surfaces, the steam outlet being formed in the first surface and the air inlet being formed in the second surface, so that the fabric is drawn against the second surface and steam is applied to the fabric at the first surface.

The first and second surfaces together form a convex surface.

In an embodiment air suction means may be provided inside the steamer head.

The second surface may extend from an edge of the first surface.

Conveniently, the steamer head further comprises a handle configured to orientate the front end of the main body so that the fabric of a garment is drawn against the air inlet prior to passing proximate to the steam outlet when the front end of the main body is drawn along the fabric of a garment.

The handle may extend from an opposing end of the main body to the front end, and the handle extends at an angle to the first surface of the front end.

Preferably, the steamer head further comprises an air passageway formed in the main body which extends between the air inlet and an air outlet, the air suction means being disposed in the air passageway. Alternatively the air suction means are located outside the steamer head. In such alternative embodiments the air suction means may be located in a steamer base station. In such a configuration the air passageway may comprise a hose connecting the steamer head and the air suction means.

In one embodiment, the steamer head further comprises a steam inlet through which steam is supplied to the main body and a steam passageway through which steam flows from the steam inlet to the steam outlet.

In another embodiment, the steamer head comprises a water supply inlet through which water is supplied to the main body and a heating means configured to form steam from water introduced through the water supply inlet.

Preferably, the steam outlet comprises an array of steam holes.

Conveniently, the air inlet comprises an array of air holes.

The steamer head may further comprise a filter disposed at the air inlet to prevent the ingress of loose fibres from a fabric of a garment into the air suction means.

According to another aspect of the invention, there is provided a garment steamer comprising a steamer head according to the invention.

The garment steamer may further comprise a steam generation unit, wherein the steam inlet of the steamer head is connected to the steam generation unit by a flexible pipe.

According to another aspect of the invention, there is provided a method of removing creases from a fabric of a garment using a steamer head of a garment steamer according to the invention, the steamer head comprising a front end with a steam outlet and an air inlet, and an air suction means for drawing air through the air inlet, the method comprising the steps of sucking the fabric against the front end and moving the steamer head along the fabric so that fabric drawn against the air inlet at the front end is subsequently positioned against the steam outlet so that steam is imparted on said fabric.

It is to be noted that European Patent Application EP 0 200 807 A1 discloses a combined vacuum cleaner and steam iron. The apparatus as disclosed in EP807 comprises connection means 161 for connecting with various suction tubes when the apparatus is used as a vacuum cleaning device. Connection means 161 are to be covered by a cover panel 162 when the apparatus is used as a steam iron. EP807 does not disclose a garment steamer being configured to draw the garment against air inlet openings.

It is further to be noted that European Patent Application EP 0 493 348 A1 discloses a steaming and suction brush. This brush comprises steam ejection holes 13 and suction slots 7. The steam ejection holes and the suction slots are disclosed to be on a slightly convex surface.

BRIEF DESCRIPTION OF THE DRAWINGS

Preferred embodiments of the invention will now be described, by way of example only, with reference to the accompanying drawings, in which.

DETAILED DESCRIPTION OF THE EMBODIMENTS

Figure 1:
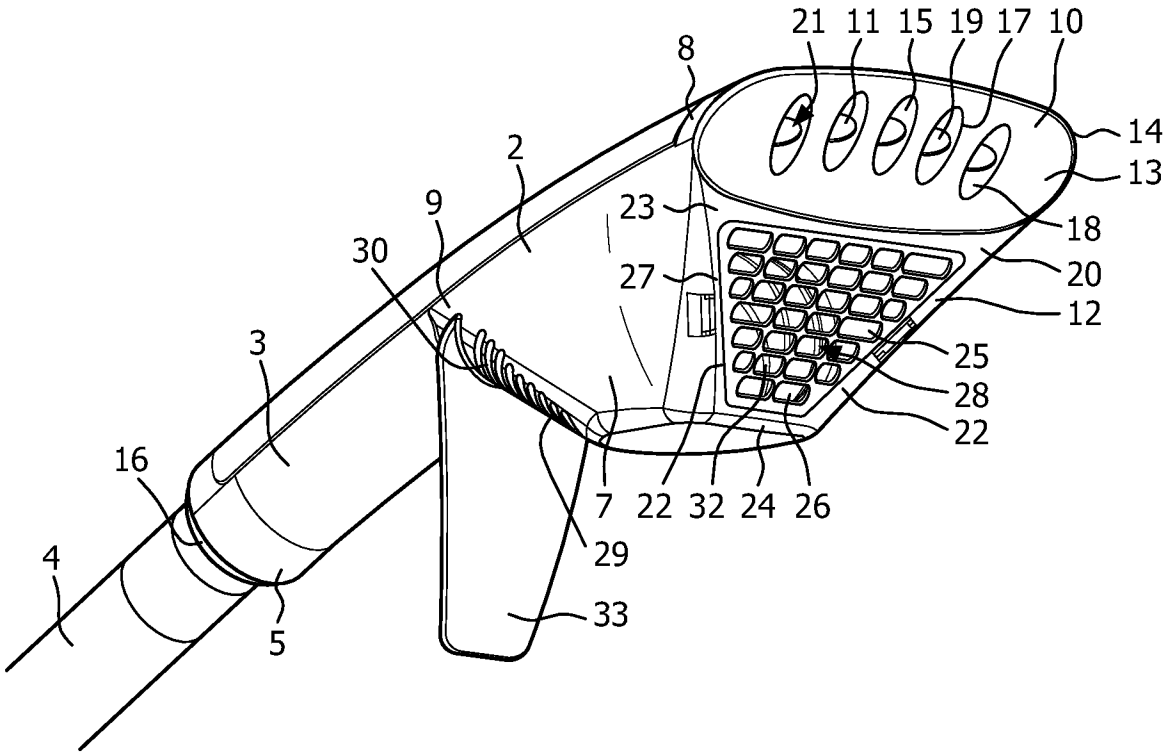
FIG. 1 shows a perspective view of an a steamer head for a garment steamer.
Figure 2:
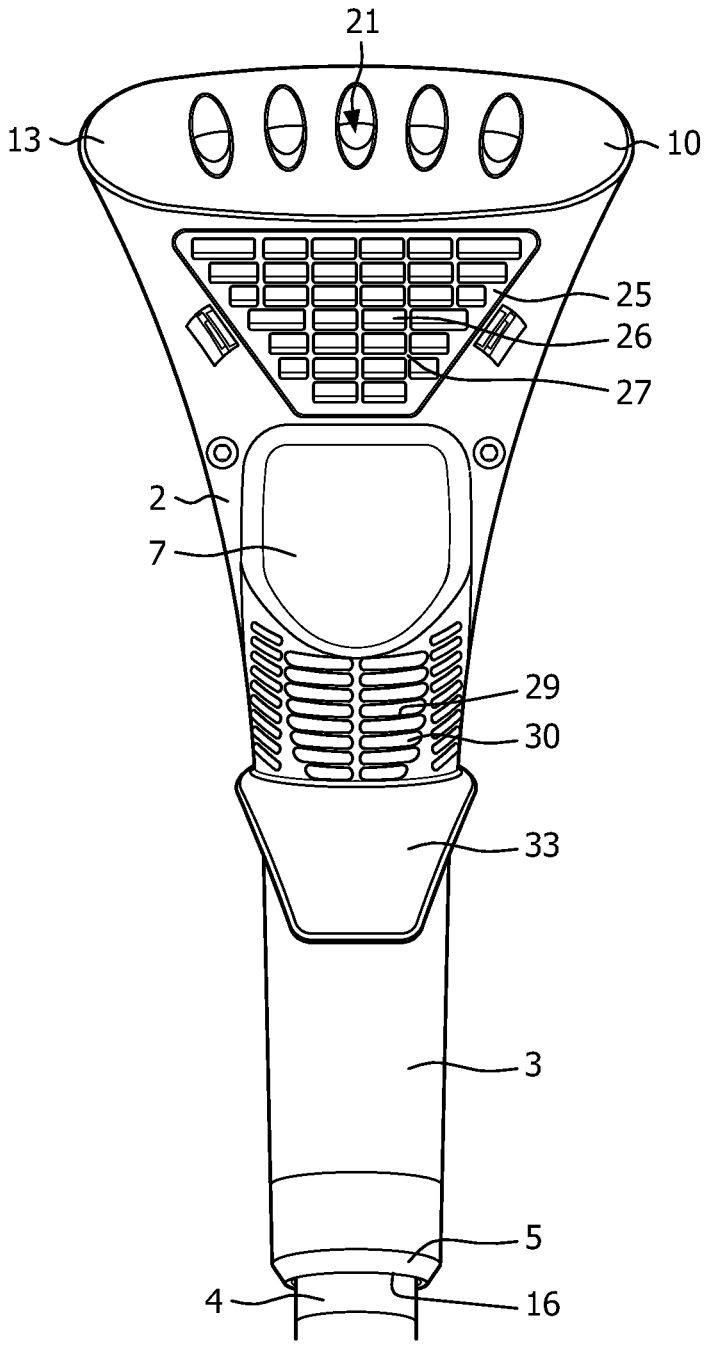
FIG. 2 shows a perspective view from below of the steamer head shown in FIG. 1.
Figure 3:
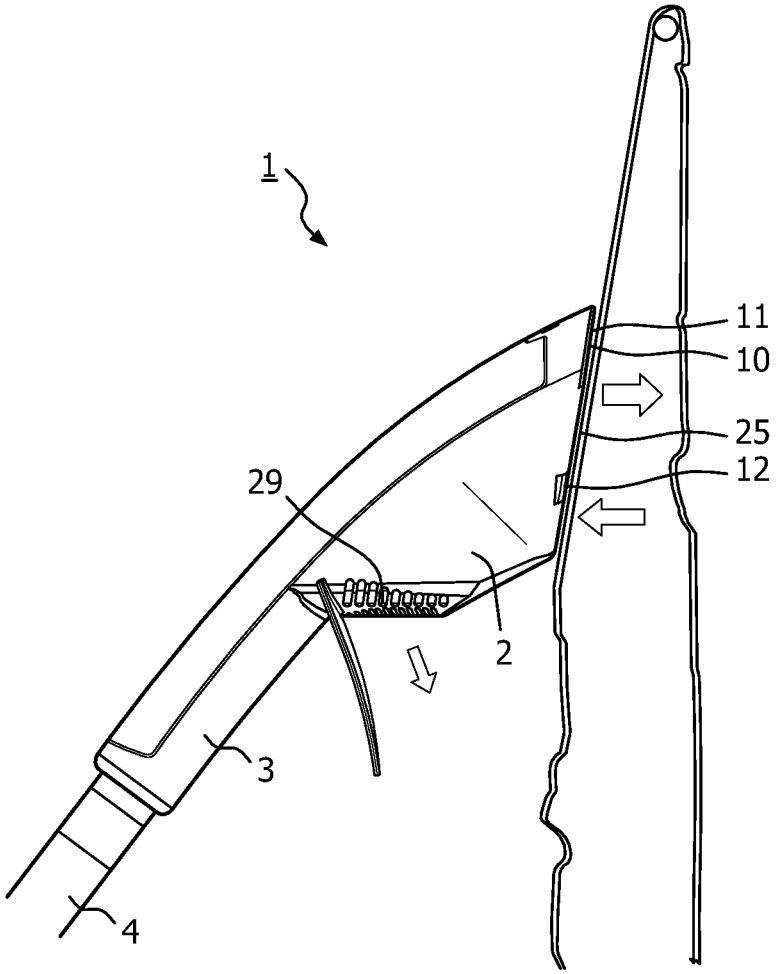
FIG. 3 shows a side view of the steamer head shown in FIG. 1, located against a garment.

Referring now to FIGS. 1 to 3, a steamer head 1 for a garment steamer is shown. The steamer head 1 forms a nozzle which comprises a main body 2 with a handle 3 extending there from. A flexible hose 4 extends from the handle 3 at a distal end 5 to the main body 2. The flexible hose 4 extends between the steamer head 1 and a steam generation unit, acting as a steam generating means, so that steam generated in the steam generation unit flows along the flexible hose 4 and is provided to the steamer head 1 along the flexible hose 4, as will be explained in detail hereinafter.

The main body 2 and the handle 3 are integrally formed and comprise a housing 7. The main body 2 of the steamer head 1 has a front end 8 and a rear end 9. The handle 3 extends from the rear end 9 of the main body 2, and the front end 8 of the main body 2 has a first surface 10 and a second surface 12. In the present embodiment, the housing 7 is formed from a heat resistant moulded plastic.

The first surface 10 is disposed at an upper end of the front end 8, and has a planar face 13 with a peripheral edge 14 extending there around. A plurality of steam holes 15 are formed through the first surface 10 to act as a steam outlet 11. The steam holes 15 communicate the planar face 13 with a steam channel 21 formed in the housing 7. The steam channel 21 extends between the steam outlet 11 at the front end 8 of the housing 7 and a steam inlet 16 at the distal end 5 of the handle 3.

The flexible hose 4 is releasably mounted to the steam inlet 16 to provide steam to the steamer head 1, and the steam channel 21 extending between the steam inlet 16 and the steam outlet 11 defines a steam passageway along which steam flows. Each steam hole 15 comprises an elongate recess 17 with a base 18 and an aperture 19 formed in the base 18 which extends to the steam channel 21. Therefore, the steam holes 15 communicate the steam channel 21 with the first surface 10 of the housing 7. Although an array of steam holes 15 form the steam outlet 11 in the present embodiment, it will be appreciated that the steam outlet may be a single outlet.

The second surface 12 is disposed at a lower end of the front end 8 and extends from a lower part of the first surface 10. The second surface 12 has a planar face 20. Side edges 22 of the second surface 12 converge from an upper edge 23 of the second surface to a lower edge 24. The planar face 20 of the second surface 12 extends parallel to, or is angled slightly away from, the planar face 13 of the first surface 10. An advantage of the above arrangement is that the air inlet 25, which is to be discussed in further detail below, is in line with the intended direction of movement of the steamer head.

Although in the present embodiment the second surface 12 is angled away from the first surface 10, it will be appreciated that the first and second surfaces 10, 12 may together form a planar surface. Alternatively, the first and second surfaces 10, 12 may together form a convex surface extending from an upper edge of the first surface to a lower edge 24 of the second surface 12. Furthermore, it will be appreciated that the first and second surfaces 10, 12 may have a convex cross-section between their side edges. An advantage of the above arrangements is to aid the drawing of fabric of a garment across the surface of the first and second surfaces 10, 12. For example, the fabric of a garment may snag on the steamer head if a concave surface is provided.

An air inlet 25 is formed through the planar face 20 of the second surface 12 and extends substantially across the planar face 20 between the side edges 22, and the upper and lower edges 23, 24. The air inlet 25 has a grill 27 extending across its opening which forms a number of apertures 26.

The air inlet 25 communicates the second surface 12 of the main body 2 with an air channel 28 formed in the main body 2. The air channel 28 is formed in the main body 2 below the steam channel 21, and extends from the air inlet 25 at the front end 8 of the main body 2 to an air outlet 29 formed at the rear end 9 of the main body 2. The air outlet 29 comprises an outlet grill 30 formed in the rear end 9 of the main body 2, below the handle 3. The air channel 28 forms an air passageway through which air sucked in through the air inlet 25 flows to and out of the air outlet 29, as will become apparent hereinafter.

An axial fan 32, acting as an air suction means, is disposed in the air channel 28 to draw air through the air inlet 25 into the air channel 28 and exhaust it through the air outlet 29. Therefore, a suction effect is generated at the air inlet 25 to cause a low pressure at the second surface 12. The fan 32 is driven by an electric motor (not shown) and powered by a battery (not shown) disposed in the housing 7, or by mains power means connected by an electric cable (not shown) which extends along the flexible hose 4. Although the air suction means is an axial fan in the present embodiment, it will be appreciated that alternative air suction means may be used to draw air in through the air inlet 25, for example, a centrifugal fan.

A deflector plate 33 is disposed between the air outlet 29 and the handle 3 to deflect air exhausted out of the air outlet 29 away from a user's hand when they are holding the handle 3. The handle 3 extends at an angle downwardly from the main body 2, such that it extends at an acute angle to the planar face 13 of the first surface 10.

Operation buttons (not shown) are mounted to the handle 3 or main body 2 to actuate the steam generating means and the air suction means so as to cause the flow of steam out of the steam outlet 11 and the flow of air into the air inlet 25. The flow of steam through the steam passageway and the flow of air through the air passageway may be operated independently or concurrently.

A filter (not shown) is fitted over the air inlet to prevent the ingress of loose fibres from the fabric of a garment or other detritus from being drawn into the fan 32.

Operation of the garment steamer according to the above exemplary embodiment will now be described with reference to FIGS. 1 to 3.

A user holds the steamer head 1 by the handle 3 with the front end 8 of the main body 2 extending away from the user's body. The arrangement of the handle 3 and main body 2, with the handle 3 extending downwardly at an angle away from the main body 2 means that in a correct holding position the first surface 10 at the front end 8 of the main body 2 is positioned above the second surface 12 at the front end 8, such that the steam outlet 11 is disposed above the air inlet 25. The steamer head 1 is fluidly connected to the steam generation unit by the flexible hose 4.

To remove creases from the fabric of a garment, the user hangs the garment from a garment hanger, such that the fabric of the garment hangs from the garment hanger in a vertical orientation and locates the steamer head 1 against the fabric. However, it will be appreciated that the garment may be arranged and supported in other orientations.

Once the steamer head 1 is positioned against the fabric, the user actuates the steam generating means and the vacuum pump means by operating the operation buttons. Upon operation, steam generated by the steam generation unit is supplied to the steam inlet 16 at the distal end 5 of the steamer head handle 3 via the flexible hose 4. The steam then flows along the steam channel 21 to the steam outlet 11 and flows out of the plurality of steam holes 15 towards the fabric disposed proximate thereto.

The fan 32 is operated to create a flow of air in the air passageway 28, such that air is sucked in through the air inlet 25, drawn through the air channel 28 and exhausted through the air outlet 29. Therefore, a low pressure is created at the air inlet 25 and the fabric of the garment is drawn against the second surface 12. As the fabric of the garment is drawn towards the air inlet 25, the fabric is held against the first surface 10 at the front end 8 of the main body 2. Steam expressed from the steam outlet 11 is therefore expelled from the steam outlet 11, directly against the fabric and is forced through the fabric or between the fabric and the first surface 10. Furthermore, as the air inlet 25 is formed on a different surface to the steam outlet 11, the steam is not drawn into the air inlet 25 and does not travel along the air passageway 28 to the air outlet 29. An advantage of this arrangement is that steam-laden air does not pass through the fan 32 and is not exhausted towards the user. In addition, as the air outlet 29 is disposed away from the air inlet 25, and so air is not exhausted back towards the fabric of a garment and does not urge the fabric away from the front end 8 of the steamer head.

The user then draws the steamer head along the fabric in a downwardly acting motion in the direction of the second surface 12 of the main body front end 8, so that the air inlet 25 is drawn across the fabric prior to the steam outlet 11 being drawn across the fabric.

As the steamer head 1 is drawn in a downwardly acting motion, with a section of the fabric being drawn against the air inlet 25, the fabric is tensioned between a garment hanger on which the garment is hung and the second surface 12 of the main body 2. Therefore, the section of fabric opposing the steam outlet 11 is in tension as steam is applied to it, which enhances the ability of the steamer head to remove creases from the fabric of a garment. In addition, as the steamer head 1 is drawn downwardly so that the fabric is positioned against the air inlet 25 prior to the fabric being positioned against the steam outlet 11, the steam expelled from the steam outlet 11 is not drawn into the air inlet 25 and so steam-laden air is not exhausted towards a user.

It will be appreciated that, even if a small portion of steam is sucked into the air passageway 28, the steam-laden air is directed away from the user by the deflector plate 33 extending between the air outlet 29 and the handle 3.

Once the steam outlet 11 formed in the first surface 10 of the main body front end 8 passes over the fabric, the fabric dries due to the heat imparted on it by the steam. The grill 27 extending across the air inlet 25 acts to prevent a garment drawn onto the second surface 12 from being drawn into the air passageway 28, and also ensures a uniform flow of air at the air inlet 25 and through the air passageway 28.

An advantage of the above arrangement, wherein the air inlet comprises a single inlet area, as opposed to a plurality of smaller air inlets spaced apart from each other, is that the suction effect created is enhanced, which ensures that the fabric is drawn against the main body of the steamer head and is not urged away by the flow of steam from the steam outlet.

A further advantage of the above described steamer head is that the steamer head does not require a heated surface against which the fabric lies to remove creases from the fabric, and so there is no requirement for a heated sole plate which may cause scorching or burning of the fabric.

Although in the above arrangements the air inlet 25 is positioned at a lower end of the front end 8 and the steam outlet 11 is positioned at an upper end of the front end 8, above the air inlet 25, it will be appreciated that another air inlet may also be disposed above the steam outlet. In this arrangement the steam outlet will be disposed between the two air inlets, which will provide additional suction to draw the fabric of a garment against the front end of the steamer head.

Figure 4:
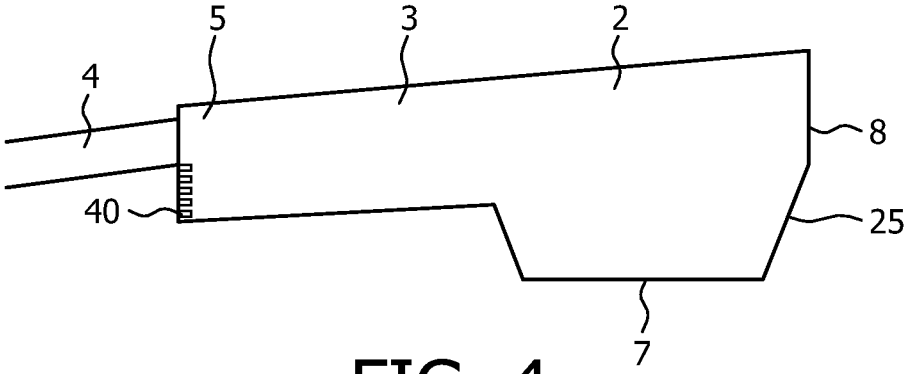
FIG. 4 shows a side view of a steamer head according to another embodiment of the invention.

Another embodiment of the steamer head is shown in FIG. 4. This embodiment of the invention is generally the same as the first embodiment described above, and so a detailed description will be omitted herein. Furthermore, components and features corresponding to components and features described in the foregoing embodiments will retain the same reference numerals. However, in this embodiment an air outlet 40 is disposed at the distal end 5 of the handle 3 to the main body 2. Therefore, the air passageway extends from the air inlet 25 formed at the front end 8 of the main body 2 in the housing 7 and extends along the length of the handle 3 to the air outlet 40. Therefore, when a user holds the handle 3 of the steamer head 1, air exhausted from the air outlet 40 is exhausted behind the user's hand.

Although in the above described embodiments of a steamer head for a garment steamer steam is provided to the steamer head through a steam inlet, and the steam is generated in the steam generation unit, it will be appreciated that steam may be provided to the steam outlet in an alternative manner. In a further embodiment of a steamer head for a garment steamer, the steamer head comprises a water inlet which is fluidly connected to a water supply hose. The water inlet communicates with a fluid passageway which extends in the housing of the steamer head, between the water inlet and the steam outlet. A heating means in the form of a heating element is disposed in the fluid passageway. As water supplied to the fluid passageway flows along the fluid passageway to the steam outlet the water comes into contact with and is heated by the heating means and turned into steam. Therefore, the steam flows out of the steam outlet.

Although claims have been formulated in this application to particular combinations of features, it should be understood that the scope of the disclosure of the present invention also includes any novel features or any novel combinations of features disclosed herein either explicitly or implicitly or any generalization thereof, whether or not it relates to the same invention as presently claims in any claim and whether or not it mitigates any or all of the same technical problems as does the parent invention. The applicants hereby give notice that new claims may be formulated to such features and/or combinations of features during the prosecution of the present application or of any further application derived there from.

The invention claimed is:

1. A steamer head for a garment steamer comprising
a main body with a front end,
a steam outlet,
a fluid supply inlet through which fluid is supplied to the steamer head, and a fluid passageway for delivering fluid from the fluid supply inlet to the steam outlet,
an air inlet formed in the front end and an air outlet disposed in the main body for exhausting air drawn in through the air inlet to an area adjacent the steamer head, and
wherein, during use, a suction force is applied to draw air through the air inlet so that a fabric of a garment disposed proximate the front end is drawn against the front end by the suction force and wherein, during use, fluid is delivered to the fluid passageway through the fluid supply inlet and steam is applied to the fabric of a garment through the steam outlet,
the front end of the main body comprising first and second surfaces, the steam outlet being formed in the first surface and the air inlet being formed in the second surface, so that the fabric is drawn against the second surface and steam is applied to the fabric at the first surface, and wherein the first surface is disposed at one end of the front end and the second surface is disposed at the other end of the front end.

2. A steamer head according to claim 1, further comprising an air suction means disposed between the air inlet and air outlet for generating a suction force.

3. A steamer head according to claim 1, wherein the second surface extends from an edge of the first surface.

4. A steamer head according to claim 1, further comprising a handle configured to orient the front end of the main body so that the fabric of a garment is drawn against the air inlet prior to passing proximate to the steam outlet when the front end of the main body is drawn along the fabric of a garment.

5. A steamer head according to claim 4, wherein the handle extends from an opposing end of the main body to the front end, and the handle extends at an angle to the first surface of the front end.

6. A steamer head according to claim 1, wherein the fluid inlet is a steam inlet through which steam is supplied to the main body.

7. A steamer head according to claim 1, wherein the fluid inlet is a water supply inlet through which water is supplied to the main body and a heating means configured to form steam from water introduced through the water supply inlet.

8. A steamer head according to claim 2, further comprising a filter disposed at the air inlet to prevent the ingress of loose fibres from a fabric of a garment into the air suction means.

9. A garment steamer comprising a steamer head according to claim 1 and a fluid source for providing fluid to the fluid inlet.

10. A garment steamer according to claim 9, wherein the fluid source is a steam generation unit, wherein the steam inlet of the steamer head is connected to the steam generation unit by a flexible pipe.

11. A garment steamer according to claim 8, further comprising air suction means.

12. A method of removing creases from a fabric of a garment using a steamer head of a garment steamer, the method comprising:
sucking the fabric against a front end at an air inlet on the steamer head,
moving the steamer head along the fabric so that fabric drawn against the air inlet at the front end is subsequently positioned against a steam outlet, and
applying steam to the fabric that is positioned against the steam outlet.

13. A steamer head according to claim 1, wherein the first and second surfaces together form a convex surface.

14. A steamer head according to claim 1, wherein a plane of the second surface is angled away from a plane of the first surface.

15. A steamer head according to claim 1, further comprising a deflector for deflecting exhaust air from the air outlet.

16. A steamer head according to claim 15 wherein the air outlet directs exhaust towards a handle of the steamer head, and the deflector isolates the handle from the exhaust.

17. A steamer head according to claim 1 wherein the air outlet is not on the front end of the main body.

18. A steamer head according to claim 4 wherein the fluid supply inlet is on an end of the handle, and the fluid passageway passes through a length of the handle.

19. A steamer head for a garment steamer comprising
a main body with a front end,
a steam outlet,
a fluid supply inlet, and a fluid passageway for delivering fluid from the fluid supply inlet to the steam outlet,
an air inlet formed in the front end and an air outlet disposed in the main body for exhausting air drawn in through the air inlet to an area adjacent the steamer head, and a handle, wherein, the fluid supply inlet is on an end of the handle, and the fluid passageway passes through a length of the handle, and wherein during use, a suction force is applied to draw air through the air inlet so that a fabric of a garment disposed proximate the front end is drawn against the front end by the suction force and wherein, during use, fluid is delivered through the fluid passageway to the fluid supply inlet and steam is applied to the fabric of a garment through the steam outlet.

* * * * *